US007156208B2

(12) United States Patent
Rickaby

(10) Patent No.: US 7,156,208 B2
(45) Date of Patent: Jan. 2, 2007

(54) STAIRLIFT

(75) Inventor: John Peter Rickaby, Blackhouse (GB)

(73) Assignee: Bison Bede Limited (GB)

( * ) Notice: Subject to any disclaimer, the term of this patent is extended or adjusted under 35 U.S.C. 154(b) by 0 days.

(21) Appl. No.: 10/519,185

(22) PCT Filed: Jun. 20, 2003

(86) PCT No.: PCT/GB03/02678

§ 371 (c)(1),
(2), (4) Date: Jun. 27, 2005

(87) PCT Pub. No.: WO04/000712

PCT Pub. Date: Dec. 31, 2003

(65) Prior Publication Data

US 2005/0279577 A1 Dec. 22, 2005

(30) Foreign Application Priority Data

Jun. 21, 2002 (GB) ..... 0214405.3

(51) Int. Cl.
*B66B 9/08* (2006.01)

(52) U.S. Cl. ..... 187/201; 187/202; 104/288; 104/300; 254/97

(58) Field of Classification Search ..... 187/201, 187/202

See application file for complete search history.

(56) References Cited

U.S. PATENT DOCUMENTS

| | | | | |
|---|---|---|---|---|
| 2,507,887 | A * | 5/1950 | Cheney | 187/201 |
| 4,913,264 | A * | 4/1990 | Voves et al. | 187/201 |
| 5,533,594 | A * | 7/1996 | Tremblay et al. | 187/201 |
| 5,908,087 | A | 6/1999 | Johansson | 187/201 |
| 6,679,353 | B1 * | 1/2004 | Muranaka | 187/202 |

FOREIGN PATENT DOCUMENTS

| | | | |
|---|---|---|---|
| DE | 3819522 | A1 * | 12/1989 |
| EP | 0 043 592 | A1 | 1/1982 |

* cited by examiner

*Primary Examiner*—Kathy Matecki
*Assistant Examiner*—Stefan Kruer
(74) *Attorney, Agent, or Firm*—Renner, Kenner, Greive, Bobak, Taylor & Weber

(57) ABSTRACT

A stair lift includes a lift assembly arranged to be driven along a rail. The lift assembly includes a chassis supporting a load bearing member such as a seat. The chassis is formed by a main member on which are mounted a drive assembly and a levelling assembly for maintaining the seat horizontal by altering the orientation of the chassis with respect to the rail as the lift assembly moves along the rail. One or both of the drive and levelling assemblies may be pivotally mounted on the chassis to permit rotation about a vertical axis so as to accommodate bends in the rail.

7 Claims, 3 Drawing Sheets

STAIRLIFT

The present invention relates to a lift assembly and more particularly to a modified method of control of the lift.

The preferred use of the present invention is as a stair lift, usually for persons but the lift assembly is of general use. Consequently, although the following description will refer to the assembly when used as a stair lift, it will be appreciated that this is one example of many uses to which the lift assembly can be put.

Stair lifts, for transporting people who have difficulty negotiating staircases from one floor to another, have been used for several years in buildings where such people reside. These stair lifts generally comprise a rail arrangement which runs along a staircase in a similar manner to a banister. They further comprise a chassis which runs along the rail arrangement which in turn supports a load bearing means generally comprising a seat. When the stair lift is in operation and the chassis and seat arrangement are running along the rail arrangement, it is very important that the load bearing means moves as smoothly as possible, and that it is kept in a horizontal orientation. This ensures that if a person being transported, who will frequently be frail and sensitive to sudden movements, he or she is not injured, and if it is an object, it will not fall from the lift and be damaged.

In many residential buildings, the stair lift will travel along a substantially straight inclined rail, or a curved rail of fixed gradient from one level to another. No seat orientation mechanism will hence be necessary as the chassis and seat can be fixed together in a predetermined orientation having regard to the gradient. However, it is also common for staircases to comprise two or more flights, often of different gradients and frequently with horizontal sections. This requires appropriate rail arrangements often with horizontal sections as corners are turned and level floor sections are negotiated. When stair lifts are required to have rails with sections which vary in gradient, it is customary to have some mechanism so that the seat always remains horizontal when the rail gradient varies. Previously, there have been a number of proposals for utilising purely mechanical levelling of the seat. One such arrangement utilised a pair of rails which are fixed in position but who se vertical separation changed depending on the gradient. The seat is attached to the rails by means of bogies running on the rails and the arrangement is such that as the seat assembly is driven along the rails, the change in rail separation causes the seat to remain horizontal.

It is an object of the present invention to provide a stair lift in which the seat is fixed with respect to the chassis but the chassis itself is arranged to change its orientation with respect to the rail in order to maintain the seat horizontal.

The present invention provides a lift assembly comprising a chassis supporting a load bearing member, the chassis having a main member on which are mounted a drive arrangement for driving the lift along a rail and a further arrangement for engagement with the rail, characterised in that the further arrangement comprising a rail engaging member and means for linearly moving the rail engaging member in a vertical direction whereby to alter the orientation of the main member so as, in use, to maintain horizontal the loading bearing member.

In order that the present invention be more readily understood, an embodiment thereof will now be described by way of example with reference to the accompanying drawings in which.

In general, a stair lift comprises a rail provided with a rack along which a powered chassis is arranged to move. A load bearing member in the form of a seat is attached to the chassis. The rail can take any one of a number of forms but at present we prefer to utilise a rail having a relatively complex cross-sectional shape with one or more flat surfaces which are generally normal to an upright section and one of which forms the running surface for the chassis. The rail has a constant cross-section throughout its length so that load bearing surfaces of the rail remain parallel.

For all but the simplest straight lifts, it is necessary to ensure that the seat remains horizontal throughout its travel and this is particularly true when the gradient of the rail changes which can, for example, occur when the lift crosses a landing or half landing. Until now, it has been assumed that the chassis should remain in a fixed orientation with respect to the rail at all times and this in the past has meant that it is necessary to pivotally mount the seat on the chassis and then control the orientation of the seat with respect to the chassis as it travels along the length of the rail.

Figure 1:
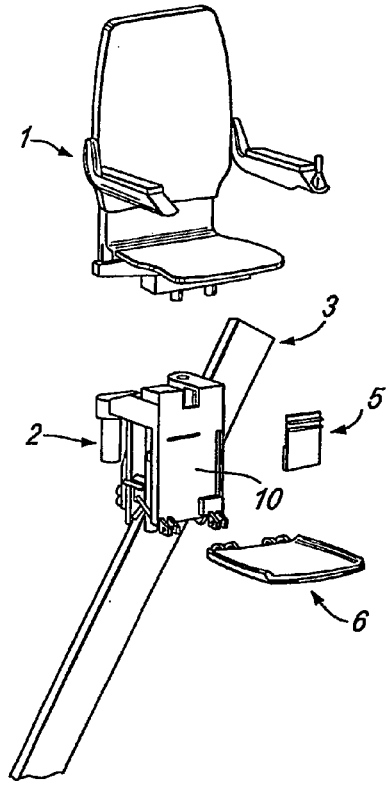
FIG. 1 shows an exploded perspective view of a general assembly of a stair lift according to the present invention.

The present invention proposes to maintain the seat level in a radically different fashion to that which has previously been the norm. Referring to FIG. 1, in the present embodiment, a seat 1 is fixed to a chassis member 2 which is attached to a rail 3 in such a manner that the orientation of the chassis member can be altered with respect to the rail in order to maintain any desired orientation with respect to the horizontal. A foot rest 4 may be attached to the chassis and an electronic control unit for controlling the stair lift is also provided.

Figure 2:
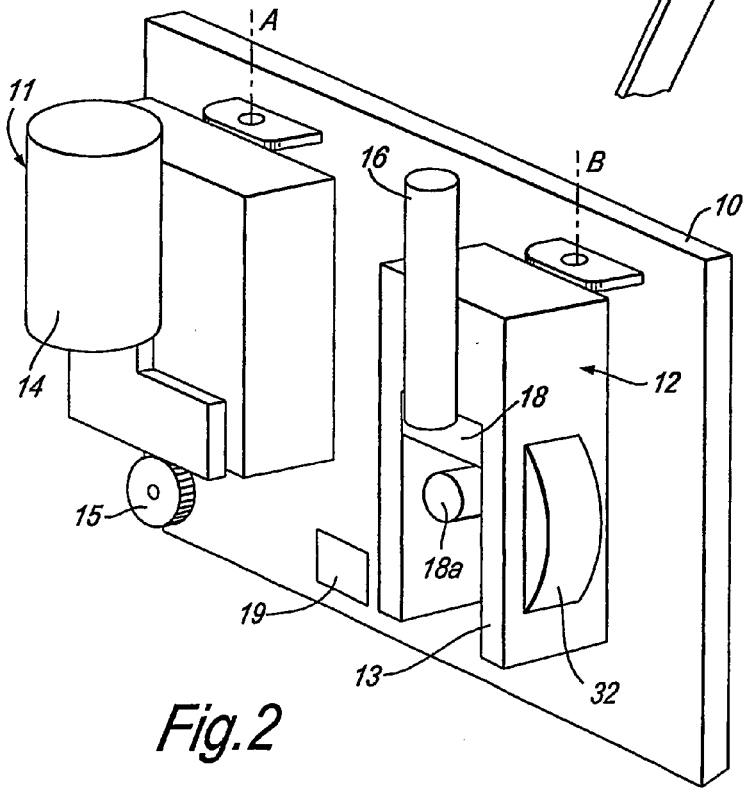
FIG. 2 shows diagrammatically the general lay out of a part of the stair lift shown in FIG. 1.

FIG. 2 shows a general layout diagram diagram of the chassis 2 but without the normal rail and other parts being present in the diagram. This is done for clarity reasons. The chassis comprises a main member 10 which in this embodiment is a central mainframe casing. A seat (not shown) is arranged to be attached to the main member 10 by a swivel pin at a suitable location so as to permit horizontal rotation of the seat about the pin, if desired. A foot rest is provided either attached to the seat or directly on one side of the member 10. On the other side of the member 10 are mounted two assemblies 11 and 12 which are spaced from each other in a direction parallel to the length of the rail and which are arranged to be in engagement with the rail. It is usually preferred that the assemblies 11 and 12 are on one side of the rail with the foot rest on the other side as this helps to balance the moving seat assembly.

The assembly 11 comprises a drive assembly which includes a pinion 15 for engagement wit the normal rack 39 (FIG. 2) only one of which is shown, are provided to ensure that the assembly 11, and the chassis connected thereto, remain upright. One roller of the pair is disposed on a respective side of the rail. The rollers on this assembly are fixed in their vertical position. The assembly 11 forms the drive unit for driving the chassis along the rail under the control of the control unit 5.

The other assembly 12 is a levelling assembly for the chassis and comprises an elongated slideway 13 provided with a slidable member 18 having a roller 18*a* for engagement with a running surface 40 (FIG. 2) of the rail. The assembly 12 is moved towards and away from the rail in a vertical direction by means of a drive mechanism 16 connected to the slidable member 18. Lateral guiding means 21 are also provided in order to maintain the member 10 upright and these will be explained in more detail later.

The chassis is provided with a sensor 19 for sensing the inclination of the main member 10 with respect to the vertical. The sensor 19 may be used in a number of ways. For example, it could be arranged to send an error signal to the control unit 5 which in turn controls operation of the drive means 16 which causes the slide member 18 to move linearly in the slideway with respect to the assembly housing 12 and which in turn causes the chassis main member 10 to change its orientation with respect to the rail. Alternatively, it could be used only during a programming mode of operation as will be described later.

It should be noted that the assemblies 11 and 12 are mounted to the chassis main member 10 so that they are each pivotal independently about their own respective vertical axes A and B. Otherwise, the assemblies are fixed to the chassis main member. The pivoting of the assemblies is a desirable feature in order to enable the lift to traverse inside or outside bends but it may be possible to dispense with one or both of the pivots in certain constructions.

Turning now to FIG. 2, this shows, to an enlarged scale, a side view of the two assemblies 11 and 12 when they are in position on a horizontal section of the rail. The same reference numerals are utilised for the same parts as in FIG. 1 and consequently a detailed description of FIG. 2 will not be given. However, it should be noted that when the rail is horizontal, the slide member 18 which carries the roller 18*a* is located close to the top of the slideway 13 which forms part of assembly 12. The assemblies 11 and 12 are designed and located to permit the rail to be received between the assemblies and the main member 10 so that effectively the chassis and lift is balanced on either side of the rail although this is not shown in FIG. 2. It should also be noted that the lateral guiding means 21 includes lateral guide rollers 23 and 24 for the assembly 12 and are linked to the slide 14 so that the angle of their axes of rotation can be altered. Because the rollers 23 and 24 are disposed at different heights, it is necessary to alter the angle of their respective axes of rotation by different amounts. This is achieved by means of two linkages 25 and 26 respectively, which are preferably interlinked.

Figure 3:
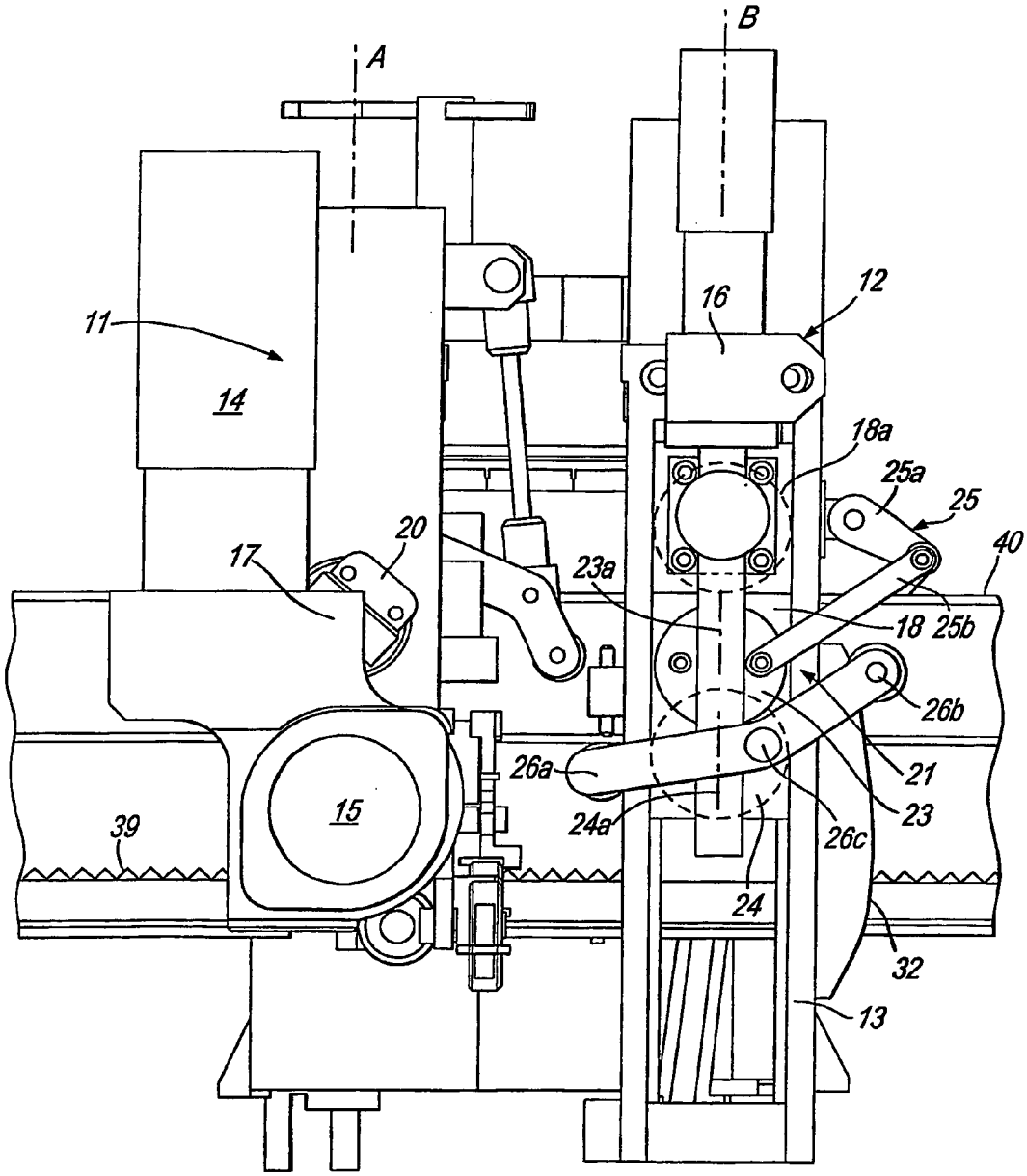
FIG. 3 shows a detailed side view of the part shown in FIG. 2 in a first orientation with respect to a rail.
Figure 4:
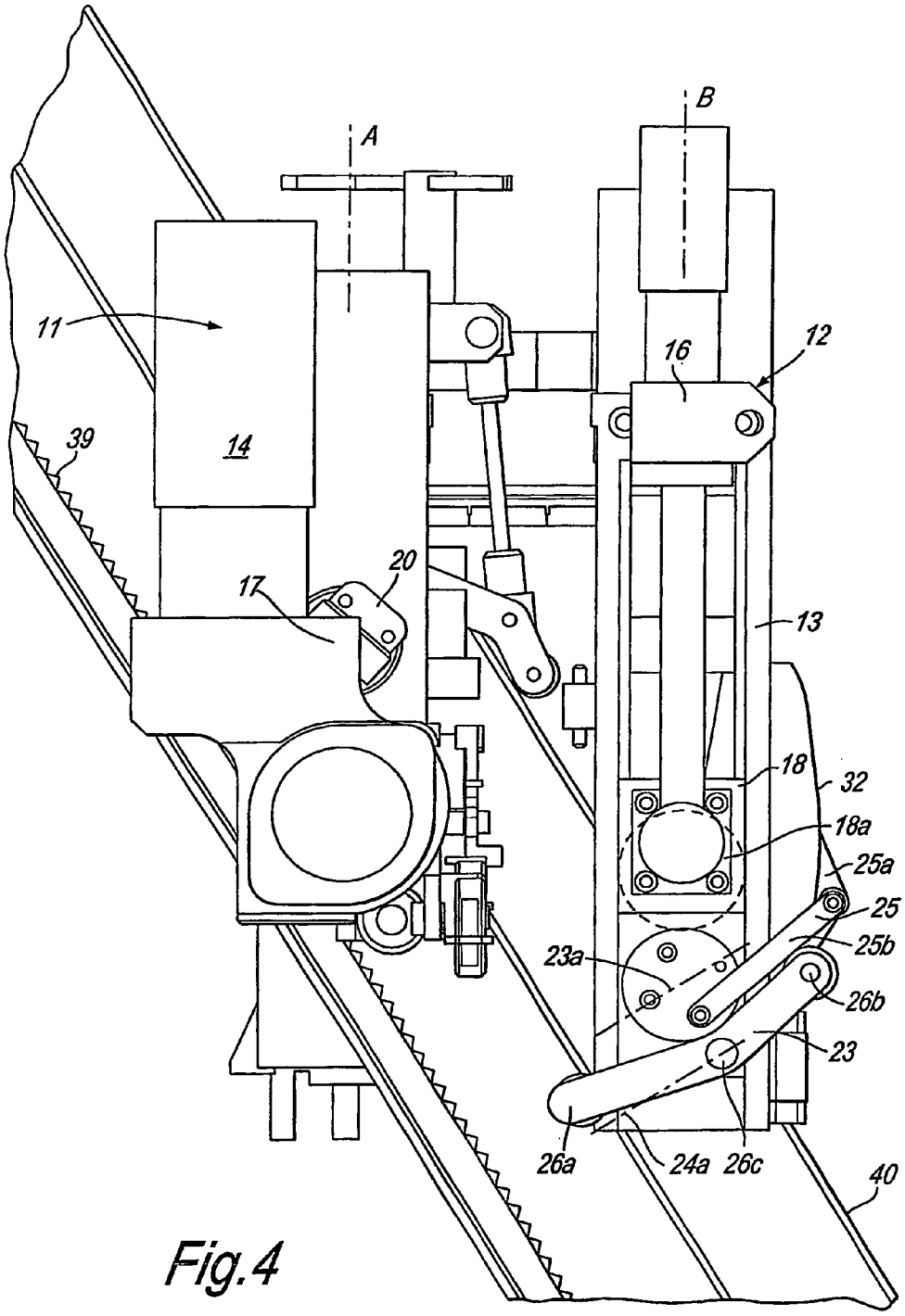
FIG. 4 shows a more detailed side view of the part shown in FIG. 2 in a further orientation.

The operation of the linkages 25 and 26 and also the orientation of the lateral rollers 23 and 24 will be seen more clearly by comparing FIGS. 3 and 4. FIG. 3 shows the position of the slide way when on a steeply inclined rail section where the slide member 18 is at or near the bottom of the slideway 13.

Roller 23 is located on one side of the rail and is mounted for rotation about axis 23*a*. As the slide moves along the slide way 13, it is necessary to change the orientation of the axis 30*a* in order to reduce frictional effects and this is achieved by means of the simple linked arms 25*a* and 25*b*. On the other hand, roller 24 is located on the other side of the rail from the roller 23 and is mounted for rotation about an axis 24*a*. In order to modify the orientation of the axis of rotation 24*a*, the linkage is formed by a bell crank lever pivoted at the end 26*a* to the slide member 18 and where free end 26*b* is pivoted with a cam member for engagement with a cam surface 32 fixed to the slideway 13. The bearings for the roller 24 are connected to the lever at point 26*e*.

Various modifications can be made to the above embodiment. For example, the drive arrangement for the slide member 18 is preferred to be a worm drive but could equally be a ball screw arrangement. It is also possible to utilise piston and cylinder devices. Also, additional or alternative guide roller arrangements can be utilised in order to laterally stabilise the chassis.

It is to be particularly noted that the drive assembly does not have a roller corresponding to the main roller of the assembly 12, in other words there is no roller on the drive arrangement 11 which rides on the same surface as does the main roller of the assembly 12. This means that the chassis is arranged to be mounted for movement on the pinion 15 and the main roller. The pinion then has a load bearing as well as driving function.

It is possible for the drive assembly to be fitted with a separate load supporting roller but if this is the case then we prefer to have a roller mounted on the same centre as the drive pinion as this avoids potential problems due to jamming as the angle between the assembly 12 and the rail alters. It is also desirable to provide a further lateral stabilising roller on the other side of the rail from the drive pinion to ensure that the drive pinion does not disengage from the rack.

Further, the drive assembly 11 is seen as being disposed on the "uphill" side of the chassis member but this need not be the case. However, rather than the levelling assembly 12 extending in order to keep the chassis level, it would have to contract or else be fitted below the running surface of the rail.

Also, it is preferred that the levelling control exercised by the control unit 5 is not an actual closed loop arrangement but is a pre-programmed levelling control system. In this case, the lift has two distinct modes of operation:

1) Program Mode

In this mode of operation the control unit maintains the seat level by use of the sensor 19 which is in the form of a Gravitational Accelerometer to measure seat angle relative to the vertical. The lift is run slowly up on the rail with the control unit recording data representing both the position of the levelling motor and the relative position of the lift along the rail at all positions on the rail eg by counting teeth on the rack. Other information needed to operate the lift is also recorded such as desired running speed, positions of the end stops etc.

2) Normal Operation

In this mode of operation the seat is maintained level by driving the levelling motor 16 to follow the positions recorded during the program mode. Main drive speed, end stops etc are also controlled using the recorded data. The Gravitational Accelerometer is not used to maintain level during this mode but is used as a failsafe device, stopping the lift if the seat fails to be maintained within a defined level range.

The invention claimed is:

1. A lift assembly comprising a chassis supporting a load bearing member, the chassis having a main member on which are mounted a drive arrangement for driving the lift along a rail and a further arrangement for engagement with the rail, characterised in that the further arrangement includes a rail engaging member, means for linearly moving the rail engaging member in a vertical direction to alter the orientation of the main member so as, in use, to maintain the loading bearing member horizontal, and an electronic control unit for controlling operation of the means for linearly moving the rail engaging member of the further arrangement, said electronic control unit including means for recording data representative of the position of the lift assembly along the rail and also the position of the means for linearly moving the rail engaging member of the further arrangement.

2. A lift assembly according to claim 1, wherein at least one of the drive and further arrangements is pivotable about a vertical axis with respect to the main member of the chassis.

3. A lift assembly according to claim 1, wherein the further arrangement comprises an additional rail engaging member, and a mechanical linkage is provided for altering the orientation of the additional rail engaging member in response to linear movement of the first-mentioned rail engaging member.

4. A stair lift comprising a lift assembly according to claim 1, and a rail provided with a rack arranged to be in engagement with the drive arrangement or the chassis.

5. A stair lift according to claim 4, wherein the rail is provided with a load bearing surface extending parallel to but spaced from the rack.

6. A stair lift according to claim 4, wherein the drive and further arrangements are disposed on the main member so as to receive at least part of the rail between the arrangements and the main member.

7. A stair lift according to claim 5, wherein the drive and further arrangements are disposed on the main member so as to receive at least part of the rail between the arrangements and the main member.

* * * * *